United States Patent [19]

Powderley

[11] 4,220,033

[45] Sep. 2, 1980

[54] BLIND RIVETING TOOL

[75] Inventor: John Powderley, Birmingham, England

[73] Assignee: USM Corporation, Farmington, Conn.

[21] Appl. No.: 950,587

[22] Filed: Oct. 12, 1978

[30] Foreign Application Priority Data

Feb. 1, 1978 [GB] United Kingdom ..... 3955/78

[51] Int. Cl.[2] ..... B21J 15/34

[52] U.S. Cl. ..... 72/391; 72/453.17

[58] Field of Search ..... 72/391, 453.17, 114; 29/243.53

[56] References Cited

U.S. PATENT DOCUMENTS

| | | | |
|---|---|---|---|
| 2,570,801 | 10/1951 | Hamlin | 72/391 |
| 4,065,952 | 1/1978 | Holloway | 72/391 |

FOREIGN PATENT DOCUMENTS

| | | | |
|---|---|---|---|
| 112104 | 12/1940 | Australia | 72/391 |
| 402671 | 12/1933 | United Kingdom | 72/391 |
| 555895 | 9/1943 | United Kingdom | 72/391 |
| 578105 | 6/1946 | United Kingdom | 72/391 |
| 916787 | 1/1963 | United Kingdom | 72/391 |

*Primary Examiner*—Francis S. Husar
*Assistant Examiner*—Gene P. Crosby
*Attorney, Agent, or Firm*—Owen J. Meegan; Richard B. Megley; Vincent A. White

[57] ABSTRACT

A blind riveting tool of the type employing a reuseable mandrel carrying a plurality of headed rivets to be successively installed has its nose portion provided with members closeable to abut the heads, respectively, during rivet setting and openable to permit passing of a rivet between the members. A part at the front of the tool is conveniently shiftable to hold the members open for reloading of rivets, or for maintaining the members closed during a rivet setting stroke.

3 Claims, 4 Drawing Figures

BLIND RIVETING TOOL

CROSS-REFERENCE TO RELATED APPLICATION

An application for U.S. Letters Patent, Ser. No. 912,373, filed June 5, 1978, in my name relates to a rivet package for use in facilitating loading of rivets in a tool of the type herein under consideration.

BACKGROUND OF THE INVENTION

This invention is concerned with improvements in blind riveting tools and is especially concerned with tools for use in setting rivets by pull-through blind riveting.

The expression "pull-through blind riveting" is used herein to denote a procedure in which a shank of a tubular rivet having a head at one end, assembled on a stem of a mandrel which has a head too large to pass through the rivet shank without deforming it, is inserted in a hole in a workpiece from one side, in such a manner that the rivet head abuts the workpiece at said one side and the shank projects from the workpiece at the other side, and the rivet is set by pulling the mandrel stem at said one side of the workpiece while holding the head of the rivet against the workpiece. The mandrel head then effects radial expansion of the rivet shank at the other side of the workpiece and is thereafter pulled right through the rivet.

It is customary in pull-through blind riveting to use a rivet-setting tool that has a nosepiece which serves as an abutment to engage the rivet head and a mandrel with a long stem on which a number, for example twenty-five, rivets are assembled, the rivets being set one after another upon relative reciprocation of the mandrel and forward feeding of the rivets through the nosepiece and up to the mandrel head. To enable the rivets to pass forwardly along the mandrel stem through the nosepiece, the nosepiece is constituted by two abutment members which separate, one on each side of a plane that includes the axis of the mandrel stem, thus allowing each rivet in turn to pass between the two members. After all the rivets on the mandrel have been set, the mandrel is removed from the tool and the same, or another, mandrel bearing fresh rivets is inserted to reload the tool.

SUMMARY OF THE INVENTION

It is one of the various objects of the present invention to provide an improved pull-through blind riveting tool which can be reloaded, with a mandrel bearing rivet, simply and quickly.

A pull-through blind riveting tool is hereinafter described in detail to illustrate the invention by way of example. The illustrative tool comprises an elongate barrel arranged to receive a mandrel having a plurality of rivets on it. Two abutment members of the illustrative tool are mounted on a front end portion of the barrel for movement between a closed condition and an open condition thereof. Rivets on a mandrel are contained within the barrel and are advanced one-at-a-time between the abutment members to a rivet-setting position outside the barrel. In their closed condition, the abutment members provide an abutment for the head of a rivet at the rivet-setting position during a rivet-setting stroke of the tool, and in their open condition they allow passage therebetween of a rivet on the mandrel.

The illustrative tool also comprises a plurality of gripping jaws mounted in a jaw case for sliding movement along paths inclined at a small angle to the axis of the barrel, a spring-pressed plunger urging the jaws forwardly of the jaw case into gripping engagement with a mandrel stem, and means for moving the jaw case rearwardly of the tool while the jaws are gripping the mandrel. This movement of the jaw case causes a rivet at the rivet-setting position which has its head abutted by the abutment members to be set by having the head of the mandrel pulled through it.

The illustrative tool comprises a catch member mounted on the barrel for temporarily retaining the abutment members in their open condition to facilitate loading of the tool with rivets. The catch member is movable between a first position, in which the abutment members are allowed to assume their closed condition, and a second position in which the abutment members are retained in their open condition thereby. The catch member of the illustrative tool is in the form of a collar around the front end portion of the barrel, the abutment members being caused to assume their open condition by rotation of the collar from its first to its second position.

In the illustrative tool the abutment members are mounted for movement longitudinally of the barrel. The collar comprises a cam face which upon rotation of the collar to its second position displaces a cam member in contact therewith longitudinally of the barrel. This movement of the cam member causes a forward movement of the abutment members longitudinally of the barrel, to cause the abutment members to assume their open condition: a peg secured to the barrel serves to separate the abutment members as they are driven forward. Furthermore upon rotation of the collar to its second position, the gripping jaws are caused to separate and release a mandrel held thereby.

The invention provides in one of its aspects a pull-through blind riveting tool comprising an elongate barrel arranged to receive a mandrel having a plurality of rivets on it, abutment members mounted on a front end portion of the barrel for movement between a closed condition in which the members provide an abutment for a rivet head during a rivet-setting stroke of the tool and an open condition in which a rivet can pass between the members, and a catch member mounted on the front end portion of the barrel for temporarily retaining the abutment members in their open condition to facilitate loading of the tool with rivets, the catch member being mounted for movement between a first position in which the abutment members are allowed to assume their closed condition and a second position in which the abutment members are retained in their open condition thereby.

BRIEF DESCRIPTION OF THE DRAWINGS

The above and other of the various objects and several aspects of the invention will become more clear from the following detailed description, to be read with reference to the accompanying drawings of the illustrative tool aforementioned. It is to be understood that the illustrative tool has been selected for description to illustrate the invention by way of example and not by way of limitation.

In the drawings.

DESCRIPTION OF PREFERRED EMBODIMENT

Figure 1:
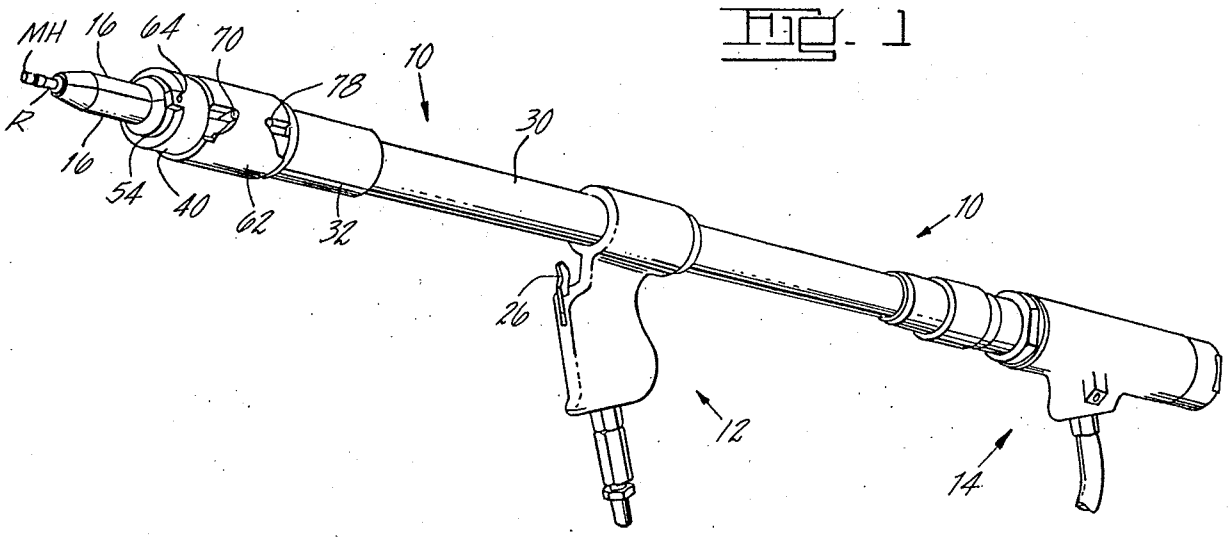
FIG. 1 is a perspective view of the illustrative tool, abutment members mounted on a front end portion of a barrel of the tool being shown in a closed condition.
Figure 2:
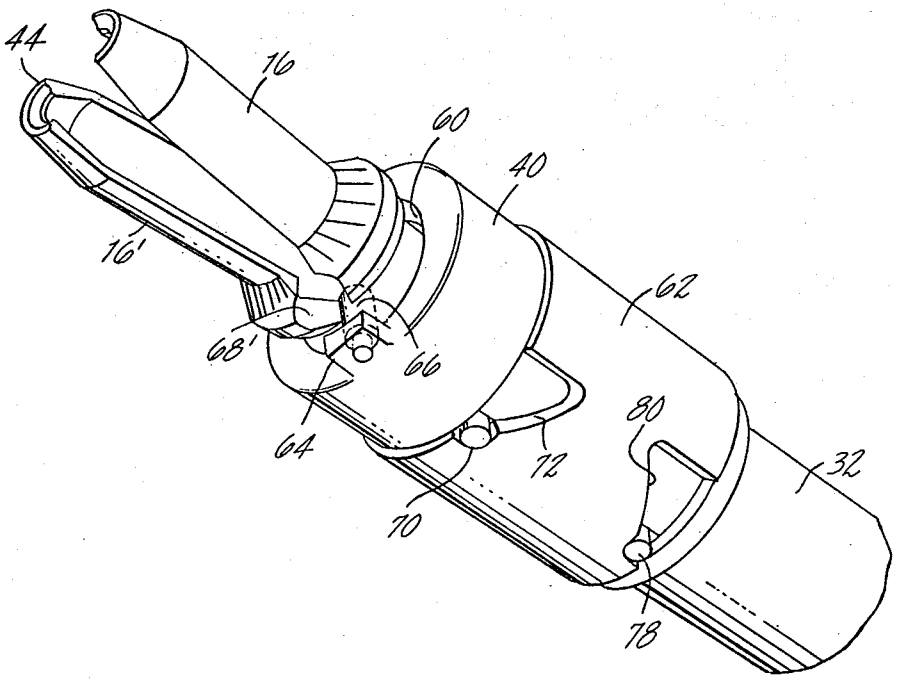
FIG. 2 is a perspective view, to a larger scale than FIG. 1, of the front end portion of the barrel of the tool, the abutment members being shown in an open condition.
Figure 3:
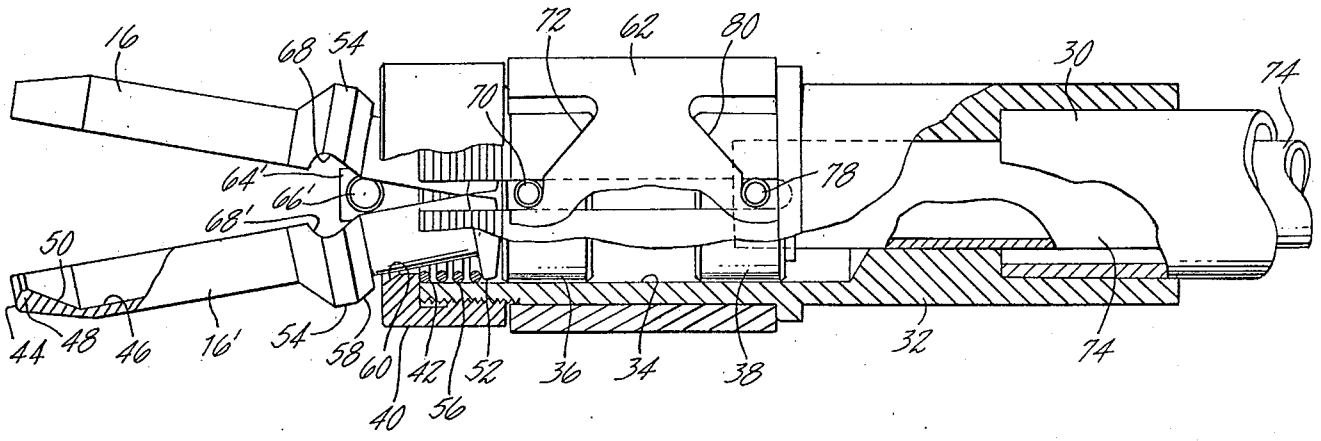
FIG. 3 is an elevational view of the front end portion of the barrel of the tool, with parts broken away to reveal the construction of the tool, and the abutment members being in their open condition.

The illustrative pull-through blind riveting tool (see FIG. 1) comprises an elongate barrel 10 arranged to receive a mandrel M having a plurality of rivets R on it. The tool also comprises a grip portion 12, at a middle portion of the barrel, and an actuating portion 14 at a rear end portion of the barrel. The tool has two abutment members 16, 16' mounted on a front end portion of the barrel for movement between a closed condition (as shown in FIG. 1) and an open condition (as shown in FIGS. 2 and 3). The rivets R on the mandrel M are advanced one-at-a-time between the abutment members to a rivet-setting position outside the barrel. In their closed condition, the abutment members 16,16' provide an abutment for the head of a rivet at the rivet-setting position during a rivet-setting stroke of the tool, and in their open condition they allow passage therebetween of a rivet on the mandrel.

Figure 4:
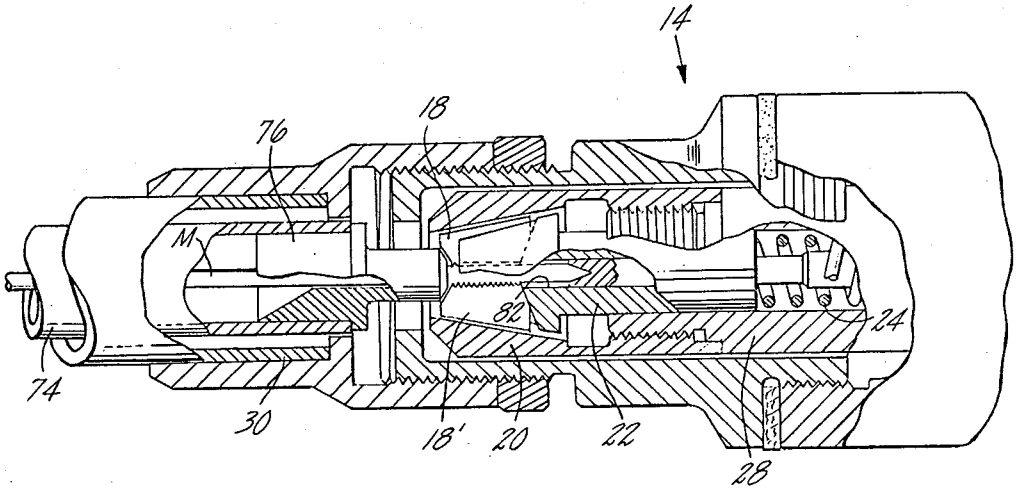
FIG. 4 is an elevational view of part of an actuating portion of the tool at a rear end portion of the barrel, with parts broken away to reveal construction.

The actuating portion 14 (see FIG. 4) of the illustrative tool comprises a plurality (viz. two) gripping jaws 18,18' mounted in a jaw case 20 for sliding movement along paths inclined at a small angle to the axis of the barrel, a jaw pusher 22 pressed by a spring 24 to urge the jaws forwardly of the jaw case into gripping engagement with a mandrel stem, and fluid pressure operated means for moving the jaw case rearwardly of the tool while the jaws are gripping the mandrel. This movement of the jaw case causes the rivet at the rivet-setting position, which has its head abutted by the abutment members 16,16' as shown in FIG. 1, to be set by having a head MH of the mandrel M pulled axially through it. The means (not shown) for moving the jaw case 20 to set a rivet R may be assumed to be of a conventional construction and operation for present purposes or be similar to that of the tool disclosed in U.S. Pat. No. 4,065,952 issued in the name of David J. Holloway. This part of the illustrative tool will not, therefore, be further described herein except to mention that operation of the tool to set a rivet may be by depression of a trigger 26, mounted on the grip portion 12 (FIG. 1) which causes a piston within the actuating portion 14 to be urged rearwardly by hydraulic pressure; the piston is coupled to a pull rod 28 (FIG. 4) screwed into a rear end portion of the jaw case 20, so that the jaw case 20 (and consequently the jaws 18,18' and the mandrel M) is pulled rearwardly. Release of the trigger 26 allows the pull rod 28 to be pushed forward again by a return spring (not shown).

The barrel 10 of the illustrative tool comprises a cylindrical housing tube 30 extending from the rear end portion to the front end portion of the barrel. At the front end portion of the barrel (FIG. 3), the end of the tube 30 is secured in a cylinder member 32 of the barrel. A front end portion of the cylinder member provides a cylindrical bore 34 in which are mounted a front piston member 36 and a rear piston member 38. An annular cap 40 is screwed onto the front end of the cylinder member 32 and has an inside diameter a little less than the diameter of the bore 34 so as to provide an annular wall 42 at the front end of the bore.

Two abutment members 16,16' constitute two halves of a split nosepiece of the tool. The nosepiece is tubular and has a front end portion which provides an annular abutment face 44 for the head of a rivet during setting of the rivet. For most of the length of the nosepiece the nosepiece has a bore 46 of constant diameter slightly greater than that of the head of a rivet R. However, at the front end portion of the nosepiece the bore is constricted to provide a shoulder 48 which prevents passage forwardly of a rivet from the bore 46 when the abutment members 16,16' are in their closed condition; the shoulder 48 presents rearwardly a frusto-conical face 50 which allows a rivet pushed forward to separate the abutment members and reach the rivet-setting position of the rivet shown in FIG. 1. The abutment members provide at a rear end portion of the nosepiece an external annular flange portion 52 of the nosepiece and also provide a seating portion 54 of the nosepiece. A compression spring 56 is mounted in the bore 34 of the cylinder member 32 to act between the annular wall 42, provided by the end cap 40, and the flange portion 52 of the nosepiece, to urge the nosepiece rearwardly. When the nosepiece is in its most rearward position, in which the abutment members 16,16' will be in their closed condition, a frusto-conical face 58 of the seating portion 54 seats on a mating face 60 of the end cap 40.

The illustrative tool comprises a catch member, in the form of a collar 62, (FIGS. 1–3) slidably mounted on the barrel, around the front end portion of the barrel, for temporarily retaining the abutment members 16,16' in their open condition to facilitate loading of the tool with rivets on a mandrel. The collar 62 is rotatable about the barrel between a first position in which the abutment members are allowed to assume their closed condition, and a second position in which the abutment members are retained in their open condition thereby.

As will be apparent from the description hereinbefore, the abutment members 16,16' are mounted for limited movement longitudinally of the barrel 10. Mounted on diametrically opposed lugs 64,64', which project forwardly from the end cap 40, are aligned pegs 66,66' (FIGS. 2 and 3) which project from the lugs radially of a longitudinal axis of the tool. When the abutment members 16,16' are in their closed condition (FIG. 1) the pegs 66,66' are received in apertures in the seating portion 54 of the nosepiece of the tool, the apertures being provided by cut-outs 68,68' in the abutment members. The front piston member 36 is arranged to engage rear end faces of the abutment members 16,16', so that forward movement of the piston member 36 causes the abutment members to be pushed forward against the action of the spring 56. Such forward movement of the abutment members results in their being separated by the pegs 66,66', the cut-outs 68,68' being shaped to ensure easy operation (see FIG. 3), and to assume their open condition.

The collar 62 is arranged to cooperate with the front piston member 36 so that by rotation of the collar, from its first to its second position, the abutment members 16,16' are caused to assume their open condition. For this purpose, two (one only shown) diametrically opposed cam members in the form of pins 70 project radially outwards from the front piston member 36. The collar 62 provides generally forwardly facing cam faces 72 against which the pins 70 are urged (indirectly by the spring 56). The cam faces 72 are shaped so that upon rotation of the collar 62 from its first position (FIG. 1) to its second position (FIGS. 2 and 3), the pins 70 in contact therewith are displaced forwardly. This movement of the pins 70 causes a corresponding movement of the abutment members 16,16′ longitudinally of the barrel, to cause the abutment members to assume their open condition as caused by the pegs 66,66′. The cam faces 72 are angularly shaped so that the collar 62 remains in its second position, with the abutment members retained in their open condition, until rotated out of this position by an operator.

The illustrative tool also comprises a cylindrical sleeve 74 mounted coaxially within the housing tube 30 and secured at its front end (FIG. 3) to the rear piston member 38. At its rear end (FIG. 4), a plunger 76 is secured in the end of the sleeve and is arranged to engage the jaws 18,18′ in the actuating portion 14 of the tool. By a rearwards axial movement of the sleeve 74, the jaws 18,18′ can be pushed rearwardly of the jaw case 20 (against the action of the spring 24) and so caused to release the mandrel M which they are gripping. Such rearwards movement of the sleeve 74 can be achieved by rearwards movement of the rear piston member 38. The rear piston member 38 is coupled to the collar 62 in a similar way as the front piston member 36, the rear piston member 38 bearing two radial pins 78 (one only shown) which engage the rearward cam faces 80 of the collar 62. Accordingly the arrangement is such that upon rotation of the collar 62 to its second position the jaws 18,18′ are caused to separate and release a mandrel held thereby.

In use of the illustrative tool with the collar 62 in its first position (FIG. 1) a mandrel M has a tail end portion located in a recess 82 (of adjustable depth) in the jaw pusher 22 and is gripped by the jaws 18,18′ owing to the jaws being urged forwardly in the jaw case 20 by the spring 24. When the tool is ready for use, a leading rivet R on the mandrel is positioned at the rivet-setting position outside the nosepiece. Upon depression of the trigger 26 by the operator the rivet is set by retraction of the mandrel M until the mandrel head MH has passed entirely through the rivet. Upon release of the trigger 26, the mandrel is pushed forward again. Means (not shown, but which may be of a conventional kind) is provided within the barrel 10 for maintaining the diminishing number of rivets successively pushed up to the mandrel head accordingly as the mandrel is pushed forward, upon release of the trigger 26, the leading rivet is pushed into the rivet-setting position outside the nosepiece, the abutment members 16,16′ being cammed aside by the head of the rivet as is passes forwardly through the front end portion of the nosepiece.

When the last rivet on the mandrel has been set, the operator rotates the collar 62 from its first position to its second position. This adjustment, as explained hereinbefore, causes the abutment members 16,16′ to assume their open condition and the jaws 18,18′ to release the mandrel. The operator can then withdraw the mandrel M from the tool through the open nosepiece, and reload the tool through the nosepiece with a mandrel loaded with rivets. Upon rotation of the collar 62 to its first position, the jaws 18,18′ again grip the mandrel and the abutment members are allowed to return to their closed condition and the tool is ready for further operation.

I claim:

1. A pull-through blind riveting tool comprising a barrel for axially receiving a mandrel adapted to slidably mount a plurality of headed rivets to be set successively, abutment members mounted on an end portion of the barrel for movement between a closed first condition in which they abut the head of a leading rivet during a rivet setting operation of the tool and to an open second condition in which a rivet can pass between the members, and a collar rotatively mounted on the front end of the barrel, said collar being formed with a cam face for displacing a cam member during rotation of the collar to urge the abutment members forwardly and radially apart and to retain said members in their open condition to facilitate loading of the tool with rivets and shiftable by rotation between said first position in which the abutment members assume said closed condition and a second position wherein the abutment members are retained in their open condition.

2. A tool as in claim 1 wherein the tool includes separable mandrel gripping jaws and said collar is formed with a cam surface operable, on rotation of the collar to its second position, to separate the jaws thus to release the mandrel.

3. A pull-through blind riveting tool comprising: a barrel for axially receiving a mandril adapted to slidably mount a plurality of headed rivets to be set successively upon successive pulling strokes of the mandril, means including separable mandril gripping jaws for effecting successive pulling strokes of the mandril, abutment members mounted on an end portion of the barrel for movement between a closed condition in which they abut the head of a leading rivet during a rivet setting operation of the tool and an open condition in which a rivet can pass between the members, and a collar disposed around the front end of the barrel, said collar being formed with cam surface means operable on rotation from a first position to a second position to cause the abutment members to move to their open condition and to separate said mandril gripping jaws to release the mandril and when in said second condition said cam surface means retaining said members and said jaws apart in their open conditions to facilitate removal of the mandril for reloading the tool with rivets.

* * * * *